United States Patent [19]

Terrell et al.

[11] Patent Number: 4,662,040

[45] Date of Patent: May 5, 1987

[54] STRAP BUCKLE

[75] Inventors: Kym A. Terrell, Seaford; Mark A. Lance, South Melbourne, both of Australia

[73] Assignee: Illinois Tool Works Inc., Chicago, Ill.

[21] Appl. No.: 870,449

[22] Filed: Jun. 4, 1986

[51] Int. Cl.[4] ..... A44B 11/25

[52] U.S. Cl. ..... 24/625; 24/615; 24/664

[58] Field of Search ..... 24/625, 615, 616, 633, 24/664, 665, 309, 316, 171, 194

[56] References Cited

U.S. PATENT DOCUMENTS

| | | | |
|---|---|---|---|
| 1,737,246 | 11/1929 | Jones | 24/625 |
| 3,979,934 | 9/1976 | Isenmann | 24/615 |
| 4,035,877 | 7/1977 | Brownson et al. | 24/171 |
| 4,150,464 | 4/1979 | Tracy | 24/615 |
| 4,282,634 | 8/1981 | Krauss | 24/616 |
| 4,425,689 | 1/1984 | Fildan | 24/664 |

FOREIGN PATENT DOCUMENTS

| | | | |
|---|---|---|---|
| 2451175 | 11/1980 | France | 24/616 |
| 947110 | 1/1964 | United Kingdom | 24/194 |
| 2117038 | 10/1983 | United Kingdom | 24/616 |

*Primary Examiner*—Victor N. Sakran
*Attorney, Agent, or Firm*—T. W. Buckman

[57] ABSTRACT

A strap buckle having male and female components which are connected to respective opposite ends of a strap and which have cooperative and releasable latching means whereby the two components are releasably held against separation. The strap is connected to the male component through connecting means arranged to permit adjustment of the effective length of the strap so that the strap can be extended or shortened as required, and in use that connecting means normally locks the strap against extension. The female component includes a strap reacting section which overlies the connecting means of the male component when the two components are connected together and thereby prevents the strap from being manipulated such as to release it from the locking influence of the connecting means. The male component has three laterally spaced arms which locate within the female component, and guard means is provided on one or more of those arms to prevent incorrect or incomplete cooperation of the two components.

13 Claims, 5 Drawing Figures

STRAP BUCKLE

Figure 1:
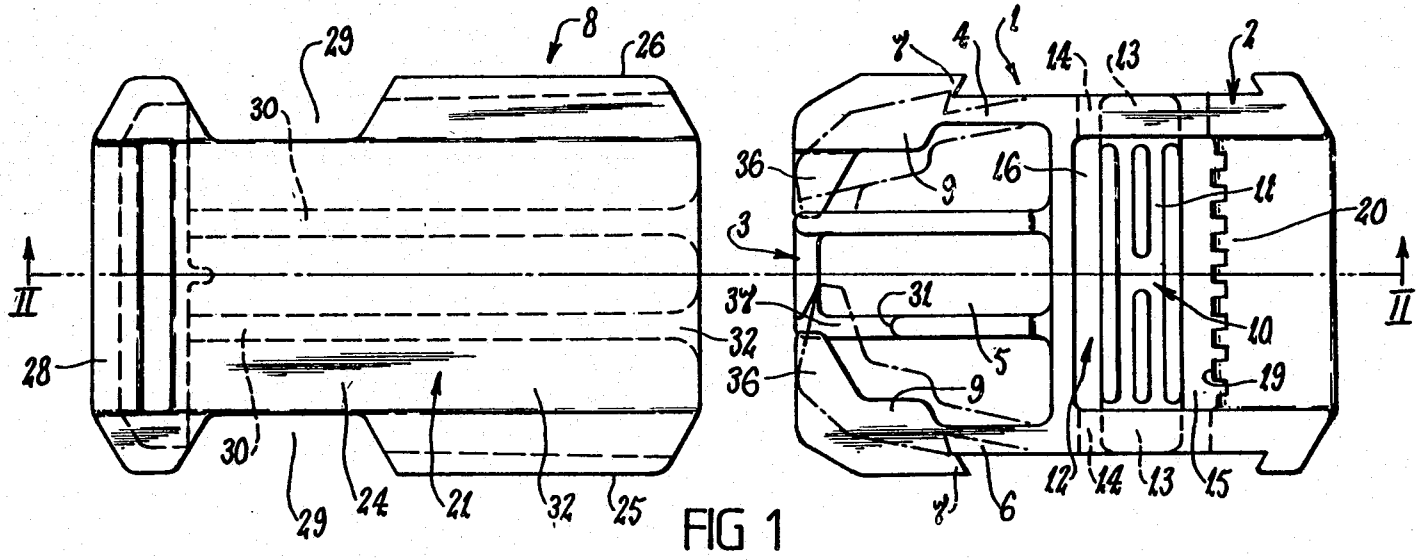

This invention relates to strap buckles and is particularly concerned with the security of such buckles.

Strap buckles having two cooperable components are commonly connected to a strap in such a way that the effective length of the strap can be varied. By way of example, one end of the strap may be non-adjustably secured to one buckle component and the opposite end portion of the strap is adjustably connected to the other buckle component. It will be convenient to hereinafter describe the invention in relation to that example arrangement although it is equally applicable to situations in which the strap is adjustably connected to both buckle components.

The adjustable connection between the strap and buckle generally includes two parallel and transverse slots in the relevant buckle component through which the strap can be passed. The arrangement is such that parts of the buckle component adjacent the slots are intended to clamp the associated strap in such a way that, under normal conditions of use, the strap will not slip through the slots and therefore retains a selected effective length. On the other hand, suitable manipulation of the buckle component and strap allows the effective length of the strap to be adjusted. One particular form of that type of adjustable connection is described in Australian Patent No. 526342.

Although adjustable connections of the foregoing kind are satisfactory in many instances it has been found that they suffer a lack of security such as to make them unsatisfactory in some circumstances. One important use of strap buckles of the foregoing kind is in relation to buoyancy jackets and vests as required to be carried on boats.

The adjustable connection referred to may be sufficiently secure under normal circumstances of use of such jackets or vests, but under abnormal and sometimes critical conditions those connections can slip and the consequences may be disasterous. For example, such connections have been found to slip when the secured strap has been used as a means for lifting a person out of the water.

One type of buckle which is currently popular is the so-called side release buckle having two laterally spaced deflectable arms on one component which engage with the other component when the buckle is operative. Deflection of the arms towards one another releases the buckle so that the two components can be separated. A buckle of that kind forms the subject of Australian patent No. 519,744.

A problem with side release buckles is that the two components may not be correctly or completely connected together, particularly when an attempt is made to close the buckle in haste. For example, it has been found that the user can sometimes force the buckle into an apparently operative condition in which one of the deflectable arms is actually located outside of the component with which it is intended to cooperate. Under those circumstances the buckle might seem to be operative, but the two components will separate when the associated strap is subjected to tension.

It is an object of the present invention according to one aspect to provide a strap buckle which overcomes or at least substantially alleviates the problem of strap slippage as discussed above. It is an object of the invention according to another aspect to minimise the possibility of the two buckle components being incorrectly connected.

A buckle according to the first aspect of the invention is characterized in that the adjustable connection as provided on one buckle component is arranged to be influenced by a strap reacting section which is engageable with a strap portion looped through the connection. The arrangement is such that the reacting section serves to prevent or hinder movement of the strap from the disposition relative to the adjustable connection at which it is held against slippage in the strap extending direction. Preferably the strap reacting section forms part of one buckle component and the adjustable connection forms part of the other, and the arrangement is such that the reacting section functions in the foregoing manner when the two buckle components are operatively connected together. With such an arrangement, extension of the strap length is prevented or at least rendered difficult, unless the two buckle components are separated.

In more particular terms, according to the first aspect of the invention there is provided a strap buckle including, a first component and a second component which are cooperatively engageable so as to be releasably held against separation, at least said first component having strap connecting means whereby a portion of a strap can be connected to said first component, said connecting means being arranged to permit adjustment of said strap portion relative to said first component and to prevent such adjustment in a strap extending direction when said strap portion has a particular disposition relative to said connecting means, and a strap reacting section provided on said second component and being arranged to overlie part of said strap portion when said components are in said cooperable engagement and to thereby at least hinder movement of said strap portion away from said particular disposition.

According to a second aspect of the invention, there is provided a strap buckle including, a female component, a passage within said female component and having an open mouth at an end of that component, a male component having a base section and a locating section which extends away from the base section and is receivable in said passage through said open mouth, said locating section including an intermediate arm extending away from said base section and two outer arms which are arranged substantially parallel to said intermediate arm, each said outer arm being located in laterally spaced relationship to said intermediate arm at a respective one of two opposite sides of said intermediate arm, latching means on each said outer arm which is engageable with said female component when said locating section is positioned within said passage so as to thereby releasably hold said components against separation, each said outer arm being adapted for inward deflection towards the other whereby said latching means are rendered inoperative to prevent said separation, and guard means on at least one said arm arranged to at least substantially bridge the space between each said outer arm and the intermediate arm when the respective said outer arm is not deflected inwardly so as to thereby guard against incorrect or partial location of said locating means within said passage.

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 2:
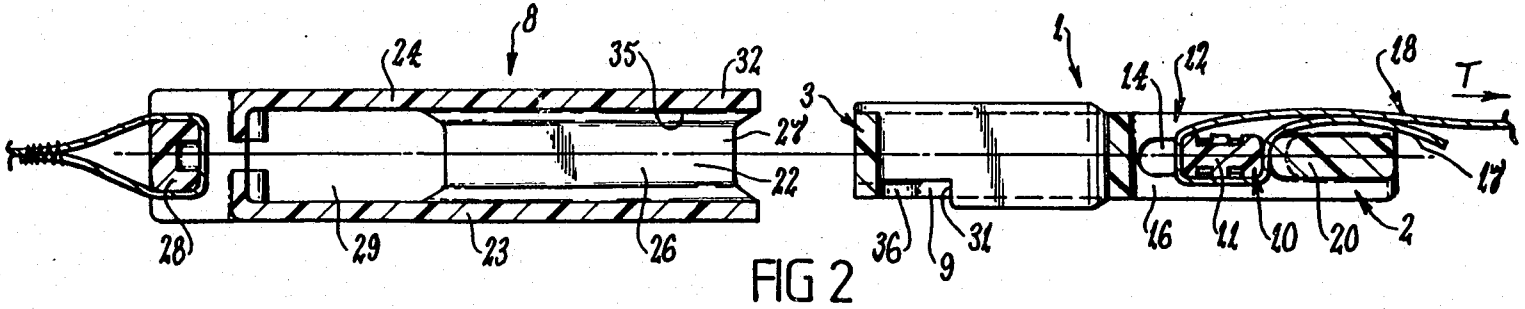
Figure 3:
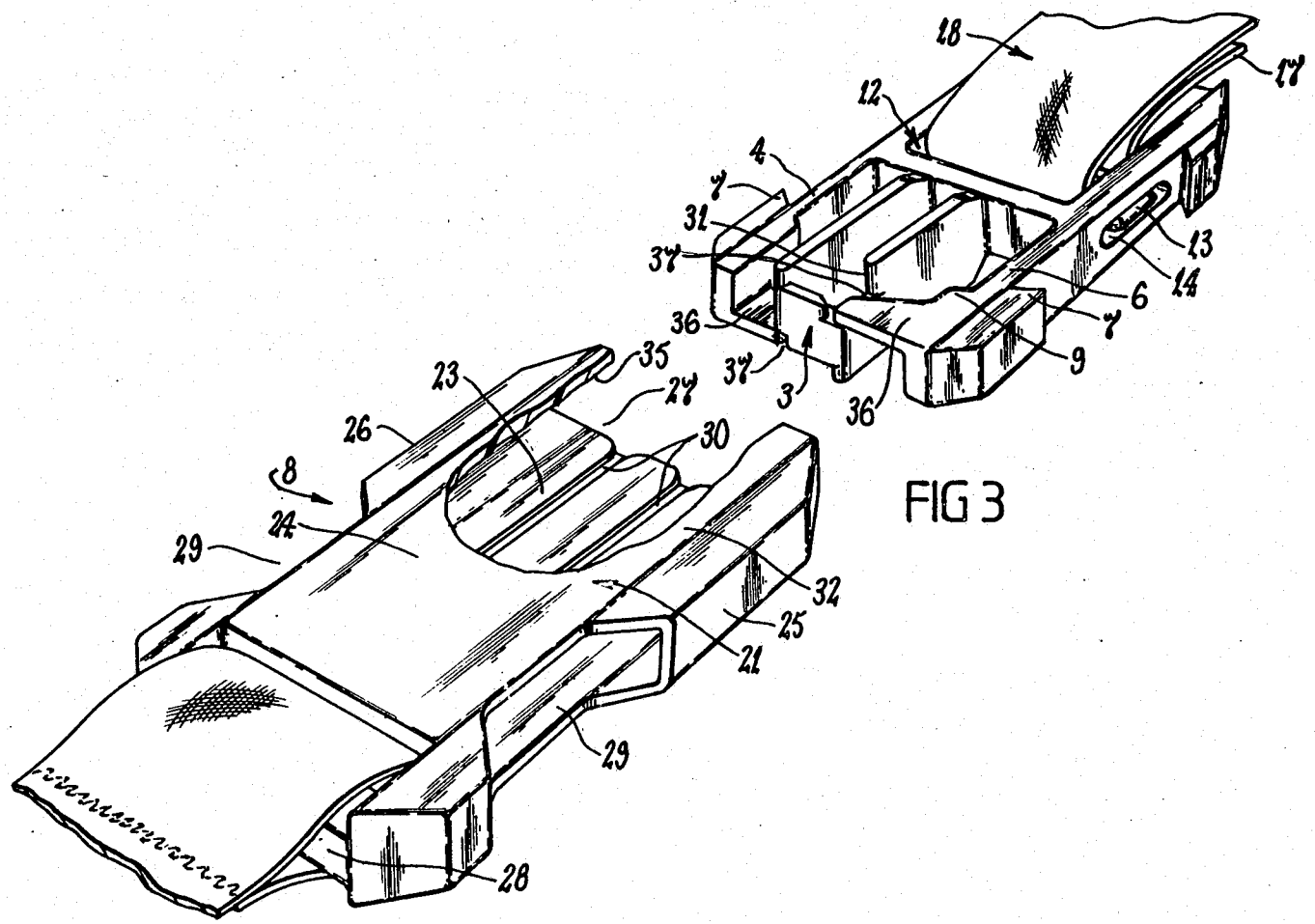
Figure 5:
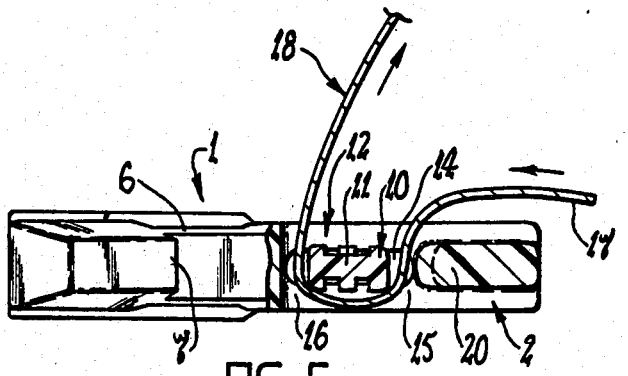
Figure 4:
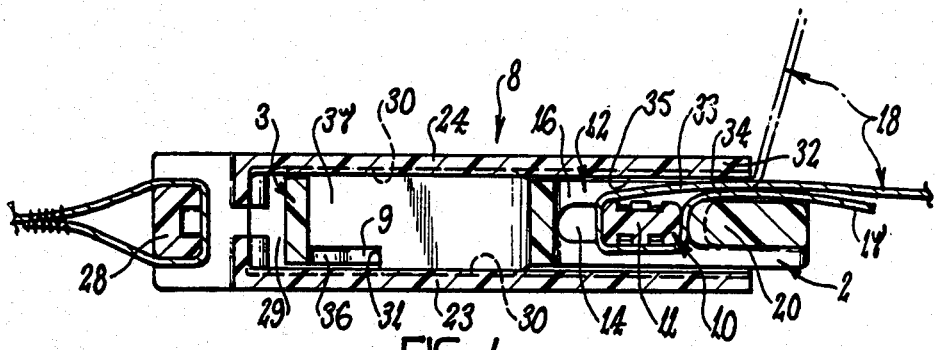

In the drawings:

FIG. 1 is a front elevational view of one form of buckle according to the invention which shows the two buckle components separated, FIG. 2 is a cross-sectional view taken along line II—II of FIG. 1 but showing a strap portion connected to each component of the buckle, FIG. 3 is a perspective view of the separated buckle components with a portion of one component broken away for convenience of illustration, FIG. 4 is a view similar to FIG. 2 but showing the two buckle components in cooperative engagement, FIG. 5 is a view showing part only of the buckle, sectioned as in FIG. 2, and also showing a strap portion disposed so as to be extendable in the strap extending direction.

As a matter of convenience the invention will be hereinafter described with particular reference to a side release buckle of the kind forming the subject of Australian Patent No. 519744, but it is to be understood that the invention is applicable to buckles of other forms. Also, the adjustable connection will be described as forming part of the female component of the buckle, whereas it may form part of the male component.

The male component 1 of the example buckle includes a base section 2 and a locating section 3 which extends out from the base section 2. The locating section 3 includes three substantially parallel and laterally spaced arms 4, 5 and 6. The intermediate arm 5 functions as a guide member as hereinafter described, and the two outer arms 4 and 6 are resilient or flexibly mounted so as to be capable of inward deflection towards the intermediate arm 5. Each outer arm 4 and 6 has a latching member 7 at a terminal end portion thereof which cooperates with the female component 8 as also hereinafter described. It is preferred, but not essential, that means is provided for limiting inward deflection of the outer arms 4 and 6 and that may comprise a stop member 9 formed on each of two outer arms 4 and 6 which projects towards the intermediate arm 5.

A two bar adjustable connection as described in patent No. 526,342 may be provided on the base section 2 of the male component 1, but other types of adjustable connections could be used. In fact, it is preferred to use a connection 10 as shown in the accompanying drawings. That connection 10 includes a bar 11 which is located within an opening 12 of the base section 2 and extends transverse to the longitudinal direction of the arms 4, 5 and 6. Opposite end portions 13 of the bar 11 are slidably located within respective slots 14 provided at the ends of the opening 12 so that the bar 11 is movable laterally relative to the component 1. The bar 11 can be positioned so that a transverse slot 15 and 16 (FIG. 1) is provided on opposite sides thereof to permit an end portion 17 of a strap 18 to be passed around the bar 11 to adopt a condition as shown in FIG. 2. Tension on the strap in the direction of arrow T in FIG. 2 naturally pulls the bar 11 towards the opposed surface 19 of the fixed bar portion 20 of the male component 1 so that the strap 18 is clamped between that surface 19 and the bar 11.

It is preferred to mold the bar 11 in situ with the body of the male component 1 so that it is permanently, but movably, mounted on the male component body. The technique for achieving such in situ molding is known.

The female component 8 of the example buckle includes a tubular body 21 which is substantially rectangular in transverse cross section. The male component 1, or at least part thereof is receivable within a passage 22 formed by walls 23, 24, 25 and 26 of the tubular body 21, and an open mouth 27 of that passage 22 is located at one end of the body 21. A transverse bar 28 or other connecting means may be provided at or adjacent the opposite end of the body 21 to permit the strap 18 to be attached to the female component 8.

Latch openings 29 are provided in each of the narrow side walls 25 and 26 of the tubular body 21 to receive and provide coaction with the latching members 7 of the male component 1. The broader walls 23 and 24 of the tubular body 21 form front and rear walls of the female component 8 and at least one of those walls is provided with guide grooves 30 for coaction with longitudinal ribs 31 of the intermediate arm 5 of the male component 1. A complete description of the latching and guiding operations is provided in Australian Patent No. 519,744.

In the particular example buckle described the aforementioned strap reacting section is formed by or includes a longitudinal extension 32 of the rear wall 24 of the female component 8. When the two components 1 and 8 are operatively connected as shown in FIG. 4, the rear wall extension 32 passes over the bars 11 and 20 of the adjustable connection 10 in close relationship and thereby serves to hold the looped strap portion in the clamped disposition relative to those bars 11 and 20. In particular, two overlying parts 33 and 34 of the strap 18 are closely confined between the fixed bar portion 20 and an opposed surface 35 of the rear wall extension 32. Those strap parts 33 and 34 are confined to an extent such that it is at least difficult to move them to a position as shown in FIG. 5 at which the clamping effect of the connection 10 is significantly reduced.

The confinement is such that the two overlapping parts 33 and 34 of the strap 18 cannot be moved substantially from the position shown in FIG. 2 at which they extend generally in the longitudinal direction of the buckle. If the strap length is to be extended, the strap parts 33 and 34 must be moved substantially towards a position as shown in FIG. 5 at which they extend transversely of the buckle longitudinal axis. Such movement may be possible beyond the end of the female component 8 as shown in broken line in FIG. 4, but that movement will not affect the clamping operation of the bar connection 10.

It is preferred that the rear wall extension 32 is of sufficient length to extend across a substantial part of the width of the fixed bar portion 20 of the adjustable connection 10. It is also preferred that the front wall 23 of the female component 8 is similarly extended, and the same may also apply to the side walls 25 and 26 so that there is substantial encapsulation of the adjustable connection 10 and engaged strap parts 33 and 34.

The invention has the significant advantage of preventing or minimizing slippage of the adjustable end portion 17 of the strap 18 even under the most severe conditions of use so that extension of the strap 18 or complete separation from the buckle is unlikely to occur. On the other hand, it remains possible to adjust the strap 18 to reduce its effective length while the two buckle components 1 and 8 are cooperatively engaged.

Although the strap reacting section has been described as forming an integral part of one of the buckle components, it may be formed as a member which is attached to one of the buckle components so as to be movable relative thereto between operative and inoperative positions.

Each of the outer arms 4 and 6 of the male component 1 is provided with guard means to minimise if not prevent the possibility of the two components 1 and 18 being incorrectly or partially engaged with one another. In the construction shown, such guard means comprises a plate-like lug 36 which is provided at the terminal end of the respective arm 4 or 6 and which projects laterally inwards towards the intermediate arm. As shown, each lug 36 substantially bridges the space which exists between the respective outer arm 4 or 6 and the intermediate arm 5 when the respective outer arm 4 or 6 is not deflected inwards. It is further preferred that one lug 36 is arranged to pass across a front side of the intermediate arm 5 while the other lug 36 passes across the rear side when the two outer arms 4 and 6 are deflected inwards either to enter the passage 22 or be released from the latch openings 29.

As best seen in FIG. 3, each lug 36 may be adapted to project into a recess 37 provided in the adjacent side of the intermediate arm 5. Because of the space bridging nature of the lugs 36, they must either pass across or through the intermediate arm 5 when the outer arms 4 and 6 are deflected inwards, and the recesses 37 are provided for that purpose.

If the male and female components 1 and 8 respectively are not correctly aligned for cooperative engagement, it is possible with prior buckles of the same general kind that one of the outer arms 4 or 6 will pass down along the outside of a respective wall 25 or 26 of the female component 8 as the two components 1 and 8 are pushed together. That results in incomplete or ineffective latching of the components 1 and 8. The lugs 36 serve to prevent such as unsatisfactory result because they present a rigid barrier to passage of a side wall 25 or 26 between the intermediate arm 5 and one of the outer arms 4 and 6.

When the outer arms 4 and 6 are pushed inwards for entry into or release from the female component 8, their respective lugs 36 extend across respective opposite sides of the intermediate arm as shown in broken line in FIG. 1.

It will be appreciated that the foregoing result could be achieved with guard members not in the form of plate-like lugs as shown. Also, such members could be provided on the intemediate arm rather than the outer arms. Alternatively, one of the guard members may be provided on the intermediate arm and another on an outer arm. In yet another alternative, both the intermediate and outer arms may be provided with guard members which overlap, at least when the outer arms are deflected inwards.

Various alterations, modifications and/or additions may be introduced into various constructions and arrangements of parts previously described without departing from the spirit or ambit of the invention as defined by the appended claims.

Having now described our invention, what we claim as new and desire to secure by Letters Patent is:

1. A strap buckle including, a first component and a second component which are cooperatively engageable so as to be releasably held against separation, said first component having strap connecting means for connecting a portion of a strap to said first component, said connecting means being arranged to permit adjustment of said strap portion relative to said first component and to prevent such adjustment in a strap extending direction when said strap portion has a particular disposition relative to said connecting means, and a strap reacting section provided on said second component and being arranged to overlie and engage part of said strap portion when said components are in said cooperable engagement and to thereby hinder movement of said strap portion away from said particular disposition and prevent loosening of said strap portion.

2. A strap buckle according to claim 1, wherein a passage is provided within said second component and an open mouth of that passage is at an end of that component, said first component having a base section and a locating section which extends away from the base section, said locating section being receivable in said passage through said open mouth thereof in order to achieve said cooperative engagement of the components, said connecting means being provided on said base section.

3. A strap buckle according to claim 2, wherein said second component includes a tubular body which is of substantially rectangular shape in transverse cross-section, and said reacting section is formed by an extension of a wall of said body which defines a longitudinally extending surface of said passage.

4. A strap buckle according to claim 3, wherein said strap portion part is closely confined between said wall extension and part of said base section which underlies that strap portion part.

5. A strap buckle according to claim 3, wherein each of a plurality of walls of said tubular body which defines a longitudinally extending surface of said passage, is extended so that said base section is substantially encapsulated by said second component when the two components are in said cooperative engagement.

6. A strap buckle according to claim 1, wherein said connecting means includes an opening formed through said first component, a bar located within that opening and extending transverse to said strap extending direction, and means mounting said bar on said first component whereby the bar is movable relative to said first component in said strap extending direction and a direction opposite thereto, the arrangement being such that a said strap portion looped about said bar is adapted to be clamped between said bar and an opposed surface of said first component.

7. A strap buckle according to claim 2, wherein said locating section includes an intermediate arm extending away from said base section and two outer arms which are arranged substantially parallel to said intermediate arm, each said outer arm being located in laterally spaced relationship to said intermediate arm at a respective one of two opposite sides of said intermediate arm, latching means is provided on each said outer arm so as to be engageable with said second component when said locating section is positioned within said passage and to thereby releasably hold said components against separation, and each said outer arm is adapted for inward deflection towards the other whereby said latching means are rendered inoperative to prevent said separation.

8. A strap buckle according to claim 7, wherein guard means is provided on at least one said arm and is arranged to at least substantially bridge the space between each said outer arm and the intermediate arm when the respective said outer arm is not deflected inwardly so as to thereby guard against incorrect or partial location of said locating section within said passage.

9. A strap buckle including, a female component, a passage within said female component and having an open mouth at an end of that component, a male component having a base section and a locating section which extends away from the base section and is receivable in said passage through said open mouth, said locating section including an intermediate arm extending away from said base section and two outer arms which are arranged substantially parallel to said intermediate arm, each said outer arm being located in laterally spaced relationship to said intermediate arm at a respective one of two opposite sides of said intermediate arm, latching means on each said outer arm which is engageable with said female component when said locating section is positioned within said passage so as to thereby releasably hold said components against separation, each said outer arm being adapted for inward deflection towards the other whereby said latching means are rendered inoperative to prevent said separation, and guard means on at least one of said arms arranged to at least substantially bridge the space between each said outer arm and the intermediate arm when the respective said outer arm is not deflected inwardly so as to thereby guard against incorrect or partial location of said locating means within said passage, said guard means including a plate-like lug member at the end portion of each said outer arm which is remote from said base section, said member projects towards said intermediate arm and is adapted to pass across the intermediate arm in an overlapping fashion toward an upper and a lower side respectively of said intermediate arm when the respective said outer arm is deflected inwards.

10. A strap buckle according to claim 9, wherein each said outer arm is resilient so as to be adapted for said inward deflection.

11. A strap buckle according to claim 9, wherein each said latching means includes a laterally outwards projection on an end portion of the respective said outer arm, and each said projection is engageable within a respective latching opening of said female component when the components are in said cooperative engagement.

12. A strap buckle according to claim 9, wherein said female component includes guide means which is engageable by said intermediate arm to guide said first component into said cooperative engagement.

13. A strap buckle according to claim 9, including strap connecting means on said male component whereby a portion of a strap can be connected to said male component and which is arranged to permit adjustment of said strap portion relative to said male component and to prevent such adjustment when said strap portion has a particular disposition relative to said connecting means, and a strap reacting section which is provided on said female component and which overlies part of said strap portion when said components are in said cooperable engagement and to thereby at least hinder movement of said strap portion away from said particular disposition.

* * * * *